US007826775B2

(12) United States Patent
Nakayama et al.

(10) Patent No.: US 7,826,775 B2
(45) Date of Patent: Nov. 2, 2010

(54) DEVELOPING DEVICE AND IMAGE FORMING APPARATUS

(75) Inventors: Masayoshi Nakayama, Tokyo (JP); Yoshitaka Fujinuma, Tokyo (JP); Susumu Tateyama, Tokyo (JP); Tatsuya Kubo, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 241 days.

(21) Appl. No.: 12/060,606

(22) Filed: Apr. 1, 2008

(65) Prior Publication Data

US 2008/0247786 A1 Oct. 9, 2008

(30) Foreign Application Priority Data

Apr. 3, 2007 (JP) ..... 2007-097073

(51) Int. Cl.
*G03G 15/08* (2006.01)

(52) U.S. Cl. ..... 399/254

(58) Field of Classification Search ..... 399/267, 399/272, 274, 277, 254; 347/140
See application file for complete search history.

(56) References Cited

U.S. PATENT DOCUMENTS

| | | | | |
|---|---|---|---|---|
| 5,581,336 | A * | 12/1996 | Matsuzaki et al. | 399/270 |
| 6,308,035 | B1 * | 10/2001 | Fukuda | 399/254 |
| 2007/0274742 | A1 | 11/2007 | Nakayama et al. | |
| 2007/0280744 | A1 | 12/2007 | Kubo et al. | |

FOREIGN PATENT DOCUMENTS

| | | |
|---|---|---|
| JP | 11-194617 | 7/1999 |
| JP | 2003-263012 | 9/2003 |
| JP | 2003-287950 | 10/2003 |
| JP | 2006-323043 | 11/2003 |
| JP | 2005/338810 | 12/2005 |
| JP | 2006-251440 | 9/2006 |

OTHER PUBLICATIONS

U.S. Appl. No. 11/867,410, filed Oct. 4, 2007, Kazuhiro Shimojima, et al.
U.S. Appl. No. 12/031,141, filed Feb. 14, 2008, Tatsuya Kubo, et al.
U.S. Appl. No. 12/036,640, filed Feb. 25, 2008, Masayoshi Nakayama, et al.
U.S. Appl. No. 12/027,636, filed Feb. 7, 2008, Susumu Tateyama, et al.
U.S. Appl. No. 12/042,848, filed Mar. 5, 2008, Kita, et al.

* cited by examiner

*Primary Examiner*—David P Porta
*Assistant Examiner*—Kiho Kim
(74) *Attorney, Agent, or Firm*—Oblon, Spivak, McClelland, Maier & Neustadt, L.L.P.

(57) ABSTRACT

A disclosed developing device includes a developer carrier including a developing sleeve and a magnetic roller provided inside the developing sleeve. The magnet roller includes a regulating magnetic pole and a pump-up magnetic pole that have different polarities from each other. Among an entire region of the moving surface of the developing sleeve in the surface movement direction, a maximum pump-up magnetic force position where the pump-up magnetic force of the pump-up magnetic pole is maximum faces an upstream position with respect to a supplying position at which the developer is supplied from a supplying screw to the developing sleeve.

11 Claims, 5 Drawing Sheets

DEVELOPING DEVICE AND IMAGE FORMING APPARATUS

BACKGROUND OF THE INVENTION

1. Field of the Invention

The present invention relates generally to a developing device for supplying a developer to a developer carrying member such as a developing sleeve by conveying the developer with a supplying screw in the rotational axial direction of the screw, and an image forming apparatus including the same.

2. Description of the Related Art

Conventionally, there is known a developing device provided with a developer carrying body including a rotatable tubular developing sleeve as the developer carrying member and a magnet roller that is provided inside the developing sleeve in such a manner as to not rotate along with the developing sleeve, and a supplying screw disposed near the developing sleeve. In such a configuration, the developing sleeve carries the developer on its surface with the magnetic force emitted by the magnet roller provided inside the developing sleeve. As the developing sleeve rotates, the developer is moved along the surface, and is conveyed to the developing position facing a latent image carrier such as a photoconductor, to be used for the developing operation. The supplying screw is disposed in such a manner that it faces the developing sleeve and its rotational axial direction is in line with the rotational axial direction of the developing sleeve. Along with the rotation of the supplying screw, the developer is conveyed along the axial direction of the supplying screw so as to be supplied to the developing sleeve. The supplying screw also collects, from the developing sleeve, the developer that is finished being used for the developing operation. The developer that has been conveyed to the edge of the supplying screw on the downstream side in the developer conveyance direction is passed on to another screw. After being replenished with toner, the developer is returned to the edge of the supplying screw on the upstream side in the developer conveyance direction. The developer is conveyed and circulated this manner. Accordingly, when the toner density of the developer decreases after the developer has been used for the developing operation on the developing sleeve, the developer is collected from the developing sleeve. Subsequently, the developer is replenished with toner so that the toner density is restored. Then, the developer is supplied to the developing sleeve once again.

Patent documents 1 and 2 describe a developing device in which the developer is collected from the developing sleeve and supplied to the developing sleeve with the use of different screws. In this developing device, a receiving screw disposed in such a manner as to face the developing sleeve is used to collect the developer that has been used for the developing operation on the developing sleeve before it is conveyed to a position facing the supplying screw. Then, the developer is returned to the supplying screw directly from the receiving screw or via another conveying screw.

In order to stabilize the amount of toner being conveyed to the developing position, a regulating member is typically provided, both in a configuration for using only the supplying screw to supply/collect the developer to/from the developing sleeve and in a configuration for using separate screws to supply/collect the developer to/from the developing sleeve. This regulating member is disposed, with a predetermined gap between the surface of the developing sleeve, in such a manner as to face a portion on the surface of the developing sleeve where the developer has passed the position facing the supplying screw and before the developer reaches the developing position. The developer on the developing sleeve passes through this gap while being conveyed by the rotation of the developing sleeve. Accordingly, the layer of the developer can be regulated to a predetermined thickness, so as to stabilize the amount of toner conveyed to the developing position.

In this configuration, the developer that has been hampered, by the regulating member, from being conveyed by the rotation of the developing sleeve, accumulates in the region extending from the position facing the supplying screw to the position facing the regulating member. The accumulated developer (hereinafter, "regulated/accumulated developer") is scraped against developer that is subsequently supplied to the aforementioned region as the developing sleeve rotates, and therefore the regulated/accumulated developer receives pressure and a shearing force. If this continues for a long period of time, the external additive particles such as silica added to the toner particles in the developer will be gradually buried in the toner particles. Accordingly, a spent phenomenon will occur, in which the toner particles adhere to the magnetic carriers. Furthermore, the toner particles that have not adhered to the magnetic carriers will be scraped against the magnetic carriers and/or collide with the magnetic carriers. As a result, each of these toner particles will become abraded and round, thereby having degraded properties. When a spent phenomenon occurs or when the toner particles become abraded, the image quality becomes degraded. For example, images with missing portions may be formed.

In the developing devices described in patent documents 1 and 2, such degradation in image quality is mitigated as follows. Among the plural magnetic poles of the magnet roller, a regulating magnetic pole and the magnetic pole that is adjacent to the regulating magnetic pole on the upstream side in the developing sleeve rotational direction have the same polarity. Furthermore, the regulating magnetic pole also serves as a pump-up magnetic pole. Specifically, the regulating magnetic pole of the magnet roller faces the regulating member via the developing sleeve, and the regulating magnetic pole has a function of attracting the developer onto the surface of the developing sleeve at the position facing the regulating member. Moreover, the magnetic pole (hereinafter, "regulation upstream magnetic pole") that is adjacent to the regulating magnetic pole on the upstream side in the developing sleeve rotational direction typically functions as a pump-up magnetic pole for attracting and pumping up the developer around the supplying screw to the surface of the developing sleeve. However, the developing devices described in patent documents 1 and 2 are not provided with a magnetic pole dedicated to the pumping-up function. They only include the regulating magnetic pole that also serves as a pump-up magnetic pole. Specifically, a regulating magnetic pole and a regulation upstream magnetic pole are made to have the same polarity, thereby forming a repulsion magnetic field in which these magnetic poles are not connected by a magnetic force line. The edge of the regulating magnetic pole on the upstream side in the developing sleeve rotational direction faces the supplying screw. The magnetic force line extending from this upstream side edge is caused to largely curve as it is repulsed from the adjacent regulation upstream magnetic pole. Subsequently, this magnetic force line passes over the regulating magnetic pole and curves into a regulation downstream magnetic pole on the opposite side. The magnetic force is relatively low at the edge part of the regulating magnetic pole on the upstream side, where the magnetic force line is caused to curve in the above described manner. Therefore, a spent phenomenon and toner abrasion in the regulated/accumulated developer can be mitigated.

Patent Document 1: Japanese Laid-Open Patent Application No. H11-194617

Patent Document 2: Japanese Laid-Open Patent Application No. 2003-287950

However, in such a configuration, even when the volume density of the developer is relatively low, the magnetic force at the position facing the regulating member is not strong enough to increase the volume of the developer. Therefore, the developer having low volume density is regulated in its layer thickness. For this reason, when the volume density of the developer changes due to environmental changes, the amount of toner conveyed to the developing position changes accordingly. As a result, it has been difficult to attain stable developing density.

Furthermore, if the supplying screw faces the above repulsion magnetic field, the developer may not be pumped up to the developing sleeve surface. For this reason, there are limitations in terms of the layout. That is, the supplying screw cannot be disposed to face a region extending between the regulating magnetic pole and the regulation upstream magnetic pole.

SUMMARY OF THE INVENTION

The present invention provides a developing device and an image forming apparatus in which one or more of the above-described disadvantages are eliminated.

A preferred embodiment of the present invention provides a developing device and an image forming apparatus in which a spent phenomenon and toner abrasion in the regulated/accumulated developer can be mitigated, changes in the developing density caused by environmental changes can be mitigated, and the freedom in the layout can be increased compared to the conventional technology.

An embodiment of the present invention provides a developing device including a developer carrying body including a developer carrying member configured to carry, on its moving surface, a developer including toner and magnetic carriers, and a magnetic field generating member including plural magnetic poles immovably provided inside the developer carrying member and arranged along a surface movement direction of the developer carrying member, wherein the developer carrying body is configured to convey the developer, along with the movement of the moving surface of the developer carrying member, to a developing position facing a latent image carrier of an image forming apparatus to develop a latent image on the latent image carrier; a supplying screw configured to supply the developer to the developer carrying member by conveying the developer in a rotational axial direction of the supplying screw; a receiving member configured to receive the developer on a surface of the receiving member, below the supplying screw in a gravity direction, in such a manner that the developer on the surface can be conveyed by the supplying screw; and a regulating member configured to regulate a layer thickness of the developer being carried on a surface region of the developer carrying member after the developer has passed a supplying position where the developer is supplied from the supplying screw to the developer carrying member, and before the developer reaches the developing position, while the regulating member is facing said surface region with a predetermined gap therebetween, wherein the magnetic field generating member further includes a regulating magnetic pole facing the regulating member via the developer carrying member, and a pump-up magnetic pole disposed adjacent to the regulating magnetic pole on an upstream side of the regulating magnetic pole in the surface movement direction of the developer carrying member, wherein the pump-up magnetic pole is configured to pump up the developer being conveyed by the supplying screw to the moving surface of the developer carrying member by attracting this developer with a pump-up magnetic force of the pump-up magnetic pole; and in the magnetic field generating member, the regulating magnetic pole and the pump-up magnetic pole have different polarities from each other, and among an entire region of the moving surface of the developer carrying member in the surface movement direction, a maximum pump-up magnetic force position where the pump-up magnetic force is maximum faces an upstream position with respect to the supplying position.

According to one embodiment of the present invention, a developing device and an image forming apparatus are provided, in which a spent phenomenon and toner abrasion in the regulated/accumulated developer can be mitigated, changes in the developing density caused by environmental changes can be mitigated, and the freedom in the layout can be increased compared to the conventional technology.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

A description is given, with reference to the accompanying drawings, of an embodiment of the present invention.

A description is given of an embodiment of a laser color printer (hereinafter, simply referred to as "printer") employing the electrophotographic method, as an image forming apparatus to which an embodiment of the present invention is applied.

Figure 1:
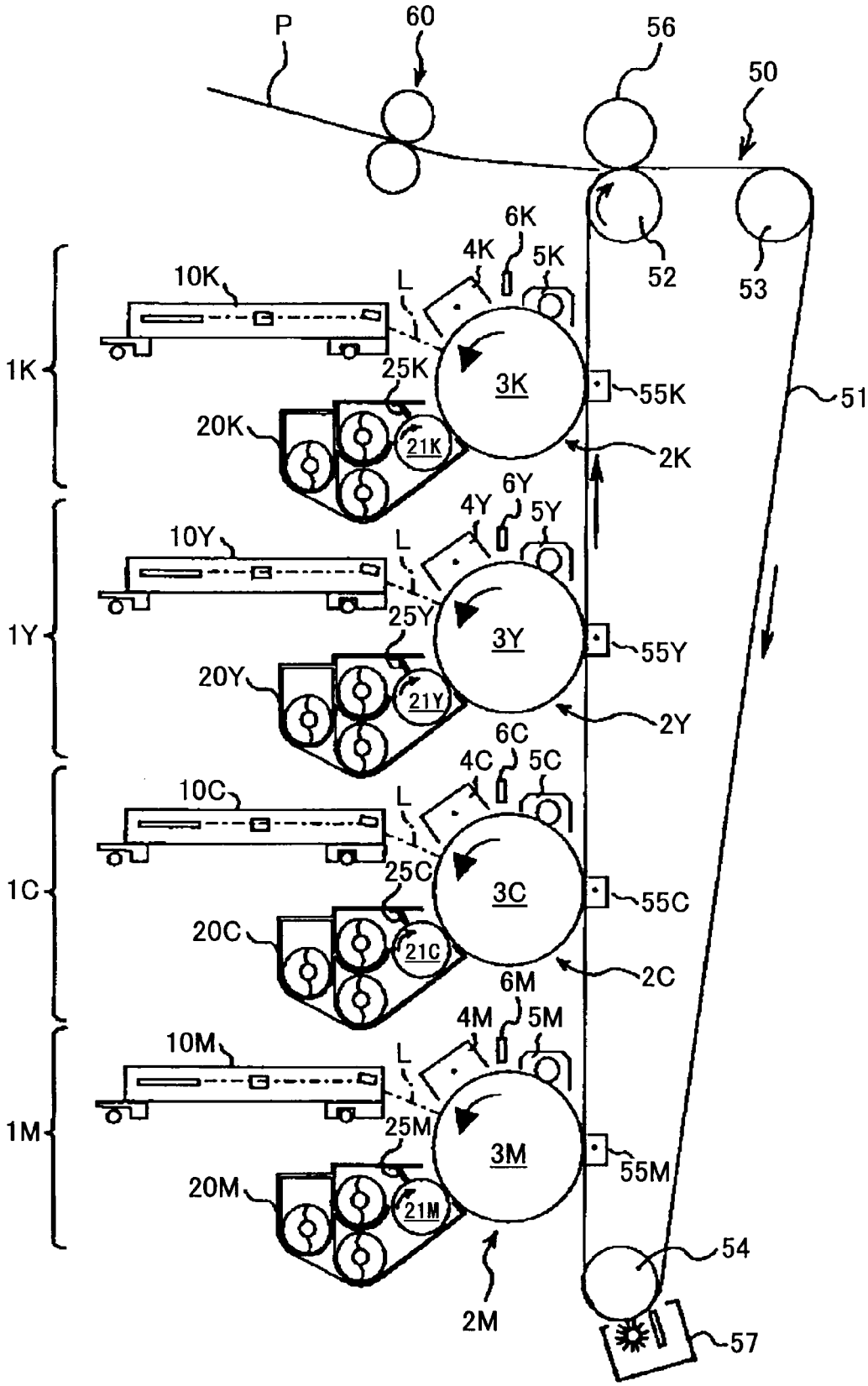
FIG. 1 is a schematic diagram of a relevant part of a printer according to an embodiment of the present invention.

First, the basic structure of the printer according to an embodiment of the present invention is described. FIG. 1 is a schematic diagram of a relevant part of the printer according to an embodiment of the present invention. This printer includes four toner image forming units 1M, 1C, 1Y, and 1K for forming toner images of the colors magenta, cyan, yellow, and black (hereinafter, "M, C, Y, K"). Furthermore, a transfer unit 50 is provided beside the toner image forming units 1M, 1C, 1Y, and 1K, which are arranged vertically with respect to each other.

The toner image forming units 1M, 1C, 1Y, and 1K have substantially the same configuration except that they use toner of different colors. The toner image forming unit 1M corresponding to M is taken as an example in the following description. The toner image forming unit 1M includes a process unit 2M, an optical writing unit 10M, and a developing unit 20M.

The process unit 2M includes a drum type photoconductor 3M rotated in a counterclockwise direction as viewed in the FIG. 1, which is surrounded by a uniform charging device 4M, a drum cleaning device 5M, and a discharge lamp 6M. These elements are held in a common casing, and are removably attached to the main unit of the printer in an integral manner. The photoconductor 3M acting as a latent image carrier is a pipe made of, for example, aluminum, which is coated by an organic photoconductive layer.

The uniform charging device 4M uniformly charges the surface of the photoconductor 3M being rotated in the counterclockwise direction as viewed in FIG. 1 to, e.g., a negative polarity with a corona charger.

The optical writing unit 10M includes a light source including a laser diode, a polygon mirror shaped as a regular hexahedron, a polygon motor for rotating this polygon mirror, an fθ lens, a lens, and a reflection mirror. The light source is driven based on image information sent from a personal computer (not shown). Laser light L irradiated from the light source is reflected by the surface of the polygon mirror and is deflected in accordance with the rotation of the polygon mirror, so that the laser light L reaches the photoconductor 3M. Accordingly, the surface of the photoconductor 3M is optically scanned so that an electrostatic latent image of M is formed on the surface of the photoconductor 3M.

The developing unit 20M for M includes a developing roller 21M. Part of the periphery of the developing roller 21M is exposed from an opening of the casing. The developing roller 21M acting as a developer carrying body includes a developing sleeve which is a non-magnetic pipe that is rotated by a driving unit (not shown), and a magnetic roller (not shown) that is provided inside the developing sleeve in such a manner as to not rotate along with the developing sleeve. An M developer (not shown), which includes magnetic carriers and negatively charged M toner, is provided inside the developing unit 20M. The M developer is attracted to and pumped up to the surface of the rotating developing sleeve of the developing roller 21M by a magnetic force of the magnetic roller acting as a magnetic field generating unit inside the developing roller 21M. In the course of being attracted to the developing sleeve, the M developer is stirred/conveyed by three conveying screws described below so that the M toner is friction charged. Then, along with the rotation of the developing sleeve, the M toner passes a position facing a developing doctor 25M acting as a regulating member, where the layer thickness is regulated. Subsequently, the M toner is conveyed to a developing position facing the photoconductor 3M.

At the developing position, a developing potential is generated between the developing sleeve and the electrostatic latent image on the photoconductor 3M. A developing bias of a negative polarity output from a power source (not shown) is applied to the developing sleeve. The developing potential electrostatically moves the M toner of the negative polarity from the developing sleeve to the latent image. Furthermore, in between the developing sleeve and a uniformly charged portion (background portion) of the photoconductor 3M, a non-developing potential is generated, which electrostatically moves the M toner of the negative polarity from the background portion to the developing sleeve. The M toner in the M developer on the developing sleeve is separated from the developing sleeve and transferred onto the electrostatic latent image on the photoconductor 3M by the function of the developing potential. As this M toner is transferred, the electrostatic latent image on the photoconductor 3M is developed into an M toner image. The M developer in which the M toner has been consumed by this developing operation is returned inside the casing as the developing sleeve rotates. Furthermore, the M toner image on the photoconductor 3M is intermediately transferred onto an intermediate transfer belt 51 of the transfer unit 50 described below.

The developing unit 20M includes a toner density sensor (not shown) which is a magnetic permeability sensor. This toner density sensor outputs a value of a voltage corresponding to the magnetic permeability of the M developer accommodated in a developer collection chamber in the developing unit 20M described below. The magnetic permeability of the developer has a good correlation with the toner density of the developer. Accordingly, the toner density sensor outputs a value of a voltage corresponding to the toner density. The value of the output voltage is sent to a toner replenishing control unit (not shown). The toner replenishing control unit includes a storage unit such as a RAM. This storage unit stores data of Vtref for M which is a target value of the output voltage from the toner density sensor for M, and data of Vtref for each of C, Y, and K which are target values of the output voltage from the toner density sensors installed in the other developing units. In the developing unit 20M for M, the value of the output voltage from the toner density sensor for M is compared with the Vtref for M. Then, an M toner density replenishing device is driven for a length of time based on the comparison results. Then, the developer collection chamber in the developing unit 20M is replenished with M toner to be used for replenishment. In this manner, the M toner replenishing device is controlled (toner replenishment control) to replenish the M developer with an appropriate amount of M toner, so that the M toner density of the M developer in the developing unit 20M that decreases due to developing operations can be maintained within a certain range. The toner replenishment control is performed in the same manner for the developing units 20C, 20Y, and 20K.

The M toner image developed on the photoconductor 3M is transferred onto the front surface of the intermediate transfer belt 51 described below. After the transfer step, residual toner (transfer residual toner) adheres on the surface of the photoconductor 3M, which residual toner has not been transferred onto the intermediate transfer belt 51. This transfer residual toner is removed by the drum cleaning device 5M. The surface of the photoconductor 3M, from which the transfer residual toner has been removed, is discharged by the discharge lamp 6M, and is then uniformly charged once again by the uniform charging device 4M.

A detailed description is given above about the toner image forming unit 1M for M. The same process is also performed by the toner image forming units 1C, 1Y, and 1K to form toner images of C, Y, and K on the surfaces of the photoconductors 3C, 3Y, and 3K, respectively.

The transfer unit 50 is provided on the right side as viewed in FIG. 1 of the toner image forming units 1M, 1C, 1Y, and 1K, which are arranged vertically with respect to each other. The transfer unit 50 includes a driving roller 52, a tension roller 53, and a subordinate roller 54 inside the loop of the endless intermediate transfer belt 51. The intermediate transfer belt 51 is stretched around these three rollers, and is endlessly rotated in the clockwise direction as viewed in FIG. 1 by the driving roller 52. The front surface of the stretched portion of the intermediate transfer belt 51 on the left side as viewed in FIG. 1, which belt is being moved endlessly in the aforementioned manner, is in contact with the photoconductors 3M, 3C, 3Y, and 3K for M, C, Y, and K, thereby forming primary transfer nips for M, C, Y, and K, respectively.

Inside the loop of the intermediate transfer belt 51, other than the three rollers described above, there are four transfer chargers 55M, 55C, 55Y, and 55K. These transfer chargers 55M, 55C, 55Y, and 55K are on the backside of the primary transfer nips for M, C, Y, and K, and are disposed in such a manner as to apply electric charges onto the back side of the intermediate transfer belt 51. By applying these electric charges inside the primary transfer nips for M, C, Y, and K, transfer electric fields are formed in such a direction as to electrostatically move the toner from the photoconductors 3M, 3C, 3Y, and 3K onto the front surface of the belt. Instead of using the transfer charger employing the corona charging method, it is possible to use a transfer roller with a transfer bias applied.

At the primary transfer nips for the respective colors, the toner images of M, C, Y, and K formed on the photoconductors 3M, 3C, 3Y, and 3K for the respective colors are transferred onto the front surface of the belt due to the nip pressure and the impact of the transfer electric field. Accordingly, toner images of M, C, Y, and K are superposed on each other, thus forming a four-color superposed toner image (hereinafter, "four color toner image") on the intermediate transfer belt 51.

At the portion where the intermediate transfer belt 51 is wound around the driving roller 52, a secondary transfer bias roller 56 is in contact with the front side of the belt, thus forming a secondary transfer nip. A secondary transfer bias is applied to the secondary transfer bias roller 56 by a voltage applying unit including a power source and wiring (not shown). Accordingly, a secondary transfer electric field is formed between the secondary transfer bias roller 56 and the driving roller 52 connected to ground. The four color toner image formed on the intermediate transfer belt 51 enters the secondary transfer nip as the belt 51 moves endlessly.

This printer is provided with a sheet feeding cassette (not shown) accommodating plural recording sheets P stacked in a pile. The top recording sheet P is sent out to the sheet feeding path at a predetermined timing. The recording sheet P that has been sent out is sandwiched between a pair of resist rollers 60 that are disposed at the end of the sheet feeding path.

The pair of resist rollers 60 is rotated to sandwich the recording sheet P that has been sent out from the sheet feeding cassette. However, once these rollers sandwich the leading edge of the recording sheet P, they immediately stop rotating. Then, the recording sheet P is sent toward the secondary transfer nip at a timing in synchronization with the four color toner image on the intermediate transfer belt 51. At the secondary transfer nip, the four color toner image on the intermediate transfer belt 51 is transferred at once (secondary transfer) onto the recording sheet P by functions of a secondary transfer electric field and nip pressure. Upon being transferred onto the white-colored recording sheet P, the four color toner image becomes a full color image. The recording sheet P having the full color image is ejected from the secondary transfer nip and then sent to a fixing device (not shown) so that the full color image is fixed.

The residual toner remaining from the secondary transfer operation, which is adhering on the surface of the intermediate transfer belt 51 after passing through the secondary transfer nip, is removed from the belt surface by a belt cleaning device 57 that is sandwiching the intermediate transfer belt 51 with the subordinate roller 54.

Figure 2:
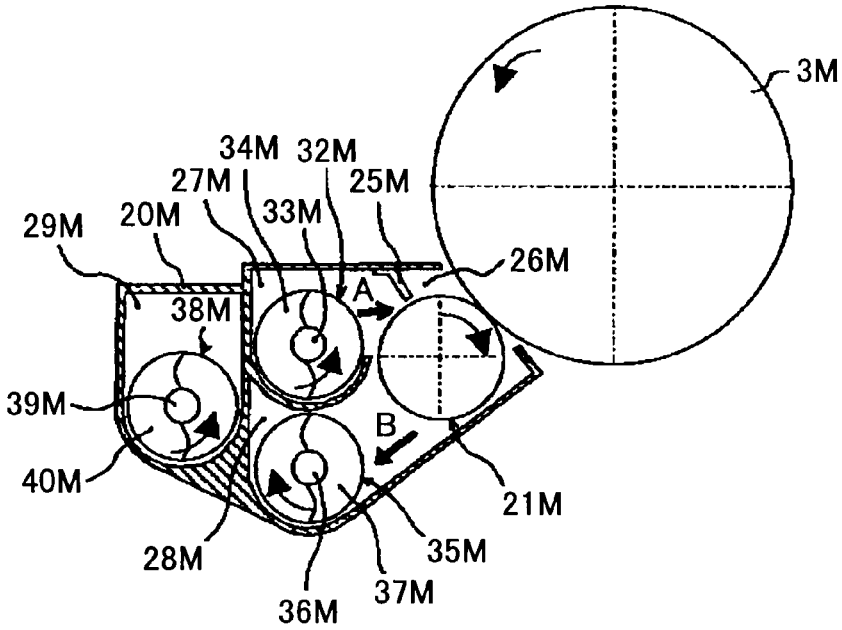
FIG. 2 is an enlarged view of a developing unit and a photoconductor of a toner image forming unit M in the printer shown in FIG. 1.

FIG. 2 is an enlarged view of the developing unit 20M and the photoconductor 3M of the toner image forming unit 1M for M. In FIG. 2, the drum type photoconductor 3M is disposed in such a manner that its axial direction extends in a direction orthogonal to the plane of the paper of FIG. 2. The developing unit 20M includes a developing chamber 26M, a developer supplying chamber 27M, a developer collection chamber 28M, and a developer returning chamber 29M. These chambers accommodate an M developer (not shown). A supplying screw 32M is rotatably provided in the developer supplying chamber 27M. Furthermore, a receiving screw 35M is rotatably provided in the developer collection chamber 28M. Moreover, a tilt screw 38M is rotatably provided in the developer returning chamber 29M.

The developing chamber 26M accommodating the developing roller 21M has an opening on its wall facing the photoconductor 3M, and part of the periphery of the developing sleeve is exposed through this opening. On the other side of the developing chamber 26M, which is the side opposite to that facing the photoconductor 3M, the developer supplying chamber 27M and the developer collection chamber 28M are in communication with each other across the entire region in the axial direction of the developing roller 21M. The developer supplying chamber 27M is disposed immediately above the developer collection chamber 28M in the vertical direction. The developer supplying chamber 27M and the developer collection chamber 28M are both in communication with the developing chamber 26M across the entire region in the longitudinal direction on the right side as viewed in FIG. 2 (the side of the photoconductor).

The supplying screw 32M accommodated in the developer supplying chamber 27M is made of a non-magnetic material such as resin, and is disposed in such a manner as to extend in a horizontal direction, similarly to the photoconductor 3M and the developing roller 21M. Furthermore, a stick-type rotational shaft member 33M and a helicoid 34M that is erected in a helical manner around the periphery of the rotational shaft member 33M are integrally rotated in a counterclockwise direction as viewed in FIG. 2 by a driving unit (not shown) including a motor and a driving transmission system.

The receiving screw 35M accommodated in the developer collection chamber 28M is also disposed in such a manner as to extend in the horizontal direction, similarly to the photoconductor 3M, the developing roller 21M, and the supplying screw 32M. Furthermore, a rotational shaft member 36M and a helicoid 37M made of a non-magnetic material such as resin are integrally rotated in a counterclockwise direction as viewed in FIG. 2 by a driving unit (not shown).

Figure 3:
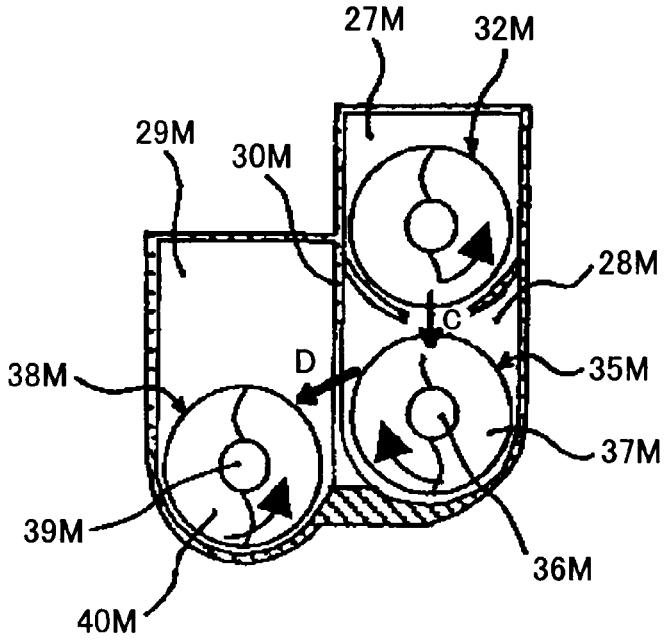
FIG. 3 is a cut-open view in a crosswise direction on one side of three conveying chambers of the developing unit shown in FIG. 2.

The developer returning chamber 29M is adjacent to the other side of the developer supplying chamber 27M and the developer collection chamber 28M, which is the side opposite to that facing the developing chamber 26M. The developer returning chamber 29M is different from the other chambers, because it extends in a tilted manner with respect to the horizontal direction. The tilt screw 38M includes a rotational shaft member 39M made of a non-magnetic material and a helicoid 40M made of a non-magnetic material erected around the periphery of the rotational shaft member 39M. This tilt screw 38M also extends in a tilted manner in the developer returning chamber 29M, and is rotated in a counterclockwise direction as viewed in FIG. 2 by a driving unit (not shown). Most of the developer returning chamber 29M is partitioned, by a partitioning wall 30M (see FIG. 3), from the developer supplying chamber 27M and the developer collection chamber 28M. However, an opening (not shown) is provided in the partitioning wall 30M, through which a part of the developer returning chamber 29M is in communication with the developer supplying chamber 27M and the developer collection chamber 28M.

Inside the developer supplying chamber 27M, as the supplying screw 32M rotates, an M developer (not shown) held in the helicoid of the supplying screw 32M is conveyed from the front side to the back side in a direction orthogonal to the plane of the paper of FIG. 2. In the course of this conveying operation, the M developer is sequentially supplied to the developing sleeve in the developing chamber 26M, as indicated by an arrow A in the figure, and is then pumped up to the developing sleeve by a magnetic force of the magnetic roller in the developing roller 21M. The M developer that is not pumped up to the developing sleeve and that is conveyed near the edge of the supplying screw 32M on the downstream side in the developer conveyance direction (near the edge in the back as viewed in FIG. 2) drops into the developer collection chamber 28M from a dropping opening provided on the bottom wall of the developer supplying chamber 27M as indicated by an arrow C shown in FIG. 3.

Referring back to FIG. 2, the M developer is conveyed to the aforementioned developing position by the rotation of the developing sleeve, and is used for the developing operation. Subsequently, by the rotation of the developing sleeve, this M developer is conveyed to the position where the developing chamber 26M and the developer collection chamber 28M are in communication with each other. Then, due to the impact of a repulsion magnetic field formed by the aforementioned magnetic roller, the M developer separates from the developing sleeve surface. Subsequently, the M developer drops into the developer collection chamber 28M as indicated by an arrow B in FIG. 2.

Inside the developer collecting chamber 28M, as the receiving screw 35M rotates, the M developer (not shown) that is held in the helicoid of the receiving screw 35M is conveyed from the front side to the back side in a direction orthogonal to the plane of the paper of FIG. 2. In the course of this conveying operation, the M developer is replenished with M toner by the above described toner replenishing device. Furthermore, the dropping M developer is received through the aforementioned dropping opening of the developer supplying chamber 27M. The M developer that is conveyed near the edge of the receiving screw 35M on the downstream side in the developer conveyance direction (near the edge in the back as viewed in FIG. 2) enters inside the developer returning chamber 29M through the opening of the partitioning wall 30M, as indicated by an arrow D shown in FIG. 3.

Figure 4:
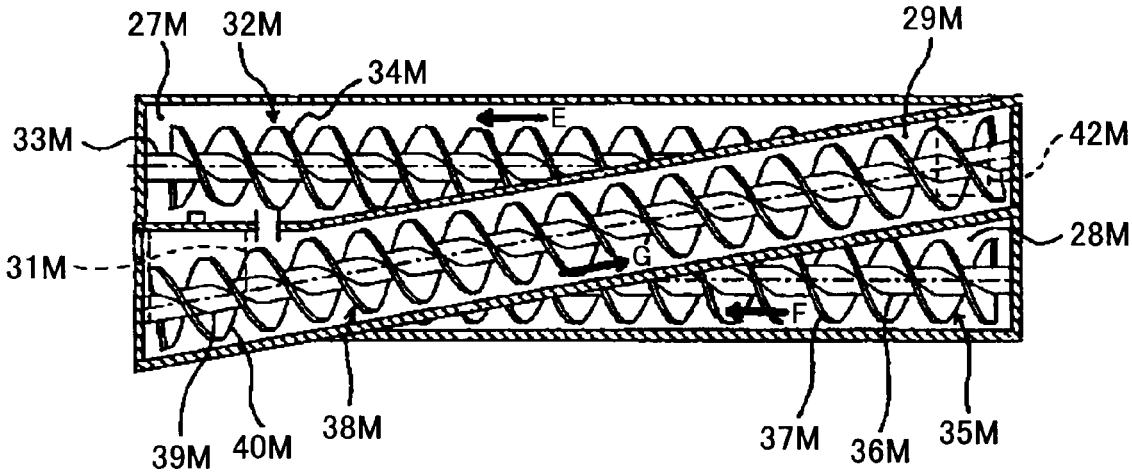
FIG. 4 is a cut-open view in a lengthwise direction of the three conveying chambers.
Figure 5:
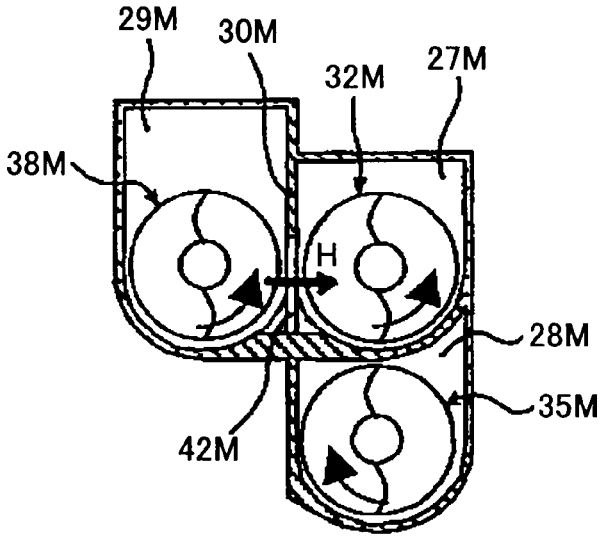
FIG. 5 is a cut-open view in a crosswise direction on another side of the three conveying chambers.

The M developer that has entered inside the developer returning chamber 29M is taken in at the edge of the tilt screw 38M on the upstream side in the developer conveyance direction. The M developer is conveyed along an upward slope as indicated by an arrow G in FIG. 4 by the rotation of the tilt screw 38M that is disposed in an obliquely upward direction from the upstream side to the downstream side in the developer conveyance direction. When the M developer is conveyed near the edge of the tilt screw 38M on the downstream side in the developer conveying direction, the M developer is returned to the developer supplying chamber 27M through a returning opening 42M provided in the partitioning wall 30M, as indicated by an arrow H in FIG. 5. Then, the M developer is taken in at the edge of the supplying screw 32M on the upstream side in the developer conveyance direction.

In the above described printer the four photoconductors 3M, 3C, 3Y, and 3K function as endlessly rotating latent image carriers for carrying corresponding latent images on their surfaces. The optical writing units 10M, 10C, 10Y, and 10K function as latent image forming units for forming latent images on the surfaces of the photoconductors after the photoconductors have been uniformly charged. The developing units 20M, 20C, 20Y, and 20K of the respective colors function as developing devices for developing the latent images on the surfaces of the photoconductors 3M, 3C, 3Y, and 3K.

Next, a description is given of developing units in conventional image forming apparatuses.

Figure 7:
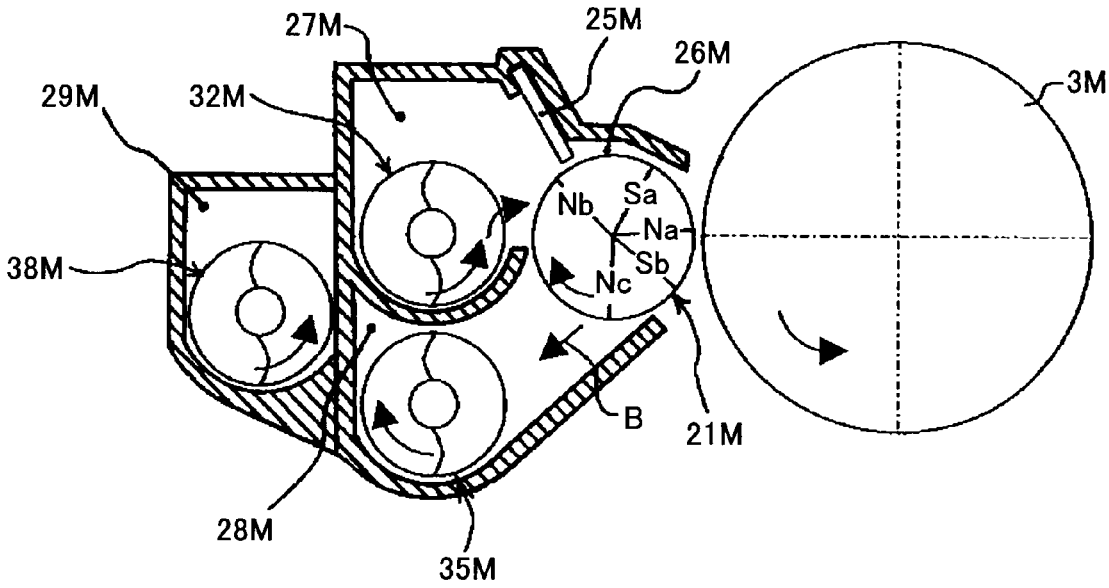
FIG. 7 is an enlarged view of a first example of a conventional developing unit (for M) shown together with a photoconductor.

FIG. 7 is an enlarged view of a first example of a conventional developing unit (for M) shown together with a photoconductor. In FIG. 7, the magnetic roller of the developing roller 21M has plural magnetic poles arranged along the peripheral direction. Among these magnetic poles, a magnetic pole denoted by Na is a developing magnetic pole for holding the developer on the developing sleeve surface at the developing position, while facing the photoconductor 3M via the developing sleeve. A magnetic pole denoted by Nb is a regulating magnetic pole for attracting the developer toward the developing sleeve surface at the layer thickness regulating position at which the developing doctor 25M regulates the layer thickness of the developer, while facing the tip of the developing doctor 25M via the developing sleeve. A magnetic pole denoted by Nc is a regulation upstream magnetic pole that is adjacent to the regulating magnetic pole Nb on the upstream side in the developing sleeve surface moving direction (developing sleeve rotational direction). A magnetic pole denoted by Sa is a conveyance-after-regulation magnetic pole for holding the developer on the developing sleeve surface, which developer is being moved by the movement of the surface of the developing sleeve. Specifically, the magnetic pole Sa holds the developer that has passed through the layer thickness regulating position where the developing doctor 25M has regulated the layer thickness, and that has not yet reached the developing position. A magnetic pole denoted by Sb is an after-developing-magnetic pole for holding the developer on the developing sleeve surface, which developer is being moved by the movement of the surface of the developing sleeve. Specifically, the magnetic pole Sb holds the developer that has passed through the developing position, and that has not yet reached the position facing the regulation upstream magnetic pole Nc.

The reference letters corresponding to the magnetic poles are indicated in FIG. 7 at positions where the magnetic forces of the corresponding magnetic poles are maximums on the developing sleeve surface. The same applies to FIG. 8 and FIG. 6 described below.

In the configuration shown in FIG. 7, the regulation upstream magnetic pole Nc adjacent to the regulating magnetic pole Nb on the upstream side in the developing sleeve surface movement direction (developing sleeve rotational direction) does not function as a pump-up magnetic pole. The regulating magnetic pole Nb, which is on the downstream side of the regulation upstream magnetic pole Nc, serves as both a regulating magnetic pole and a pump-up magnetic pole for pumping up the developer around the rotational direction of the supplying screw 32M and attracting this developer to the surface of the developing sleeve by its magnetic force. The regulating magnetic pole Nb and the regulation upstream magnetic pole Nc both have the same N polarity, thereby forming a repulsion magnetic field (not shown) in which these magnetic poles are not connected by magnetic force lines.

The edge of the regulating magnetic pole Nb on the upstream side in the developing sleeve rotational direction faces the supplying screw 32M via the developing sleeve. The magnetic force lines (not shown) extending from this upstream side edge are caused to largely curve as they are repulsed from the adjacent regulation upstream magnetic pole Nc. Thus, these magnetic force lines pass over the regulating magnetic pole Nb and curve into the conveyance-after-regulation magnetic pole Sa which is a regulation downstream magnetic pole on the opposite side. The magnetic force is relatively low at the edge part of the regulating magnetic pole Nb on the upstream side, where the magnetic force lines are caused to curve in the above described manner. Therefore, a spent phenomenon and toner abrasion in the regulated/accumulated developer (not shown) can be mitigated. Specifically, the regulated/accumulated developer is the developer that accumulates in a region on the developing sleeve surface extending from a supplying position where the developer is supplied from the supplying screw 32M to the developing sleeve, to a regulating position where the developer is regulated by the developing doctor 25M.

However, in such a configuration, even when the volume density of the developer is relatively low, the magnetic force at the position facing the developing doctor 25M is not strong enough to increase the volume of the developer. Therefore, the developer with low volume density will have its layer thickness regulated. For this reason, when the volume density of the developer changes due to environmental changes, the amount of toner conveyed to the developing position will change accordingly. As a result, it is difficult to conventionally attain stable developing density.

Furthermore, if the supplying screw 32M faces the above repulsion magnetic field, which is formed between the regulating magnetic pole Nb and the regulation upstream magnetic pole Nc, the developer may not be pumped up to the developing sleeve surface. For this reason, there are limitations in terms of the layout. That is, the supplying screw 32M cannot be disposed to face a region extending between the regulating magnetic pole Nb and the regulation upstream magnetic pole Nc.

Figure 8:
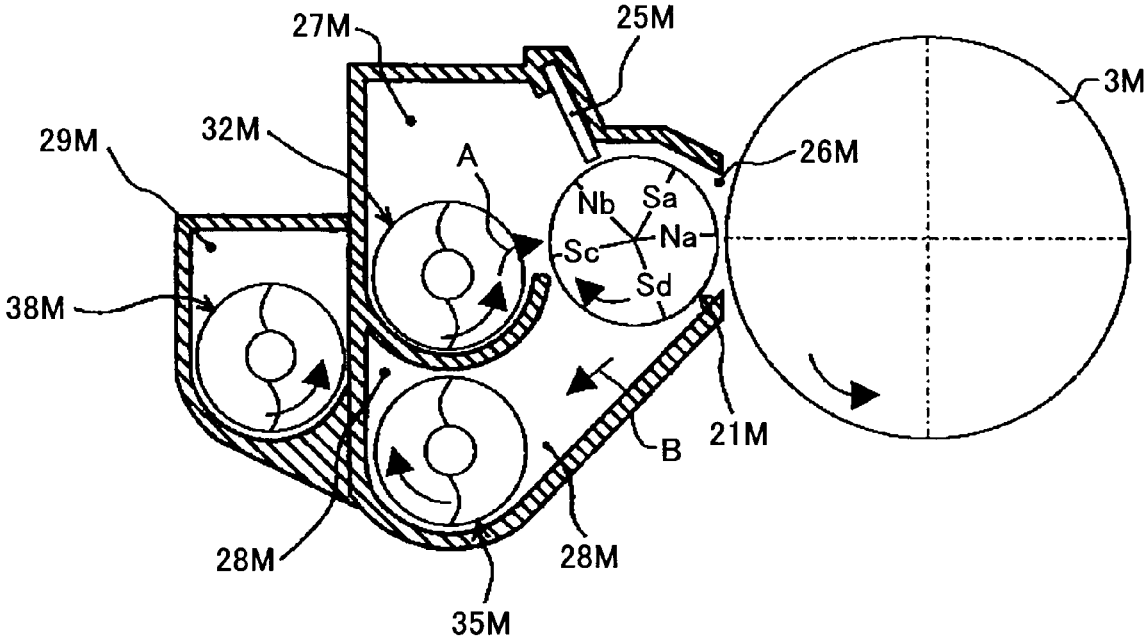
FIG. 8 is an enlarged view of a second example of a conventional developing unit (for M) shown together with a photoconductor.

FIG. 8 is an enlarged view of a second example of a conventional developing unit (for M) shown together with a photoconductor. In FIG. 8, the magnetic roller of the developing roller 21M has plural magnetic poles. Among these, a magnetic pole denoted by Na is the same developing magnetic pole as that of the first example shown in FIG. 7. Magnetic poles denoted by Nb and Sa are the same regulating magnetic pole and conveyance-after-regulation magnetic pole as those of the first example shown in FIG. 7, respectively. A magnetic pole denoted by Sc is a pump-up magnetic pole for pumping up the developer around the supplying screw 32M to the developing sleeve surface. In the second example, this pump-up magnetic pole Sc is also the regulation upstream magnetic pole adjacent to the developing magnetic pole Nb on the upstream side in the developing sleeve surface movement direction. Furthermore, a magnetic pole denoted by Sd is an after-developing-magnetic pole for holding the developer on the developing sleeve surface, which developer is being moved by the movement of the surface of the developing sleeve. Specifically, the magnetic pole Sd holds the developer that has passed through the developing position, and that has not yet reached the position facing the receiving screw 35M.

The pump-up magnetic pole Sc and the after-developing-magnetic pole Sd that is adjacent to the pump-up magnetic pole Sc on the upstream side in the developing sleeve surface movement direction both have the same S polarity, thereby forming a repulsion magnetic field (not shown) in which these magnetic poles are not connected by magnetic force lines. Along with the movement of the developing sleeve surface, the developer that has reached the position facing the receiving screw 35M is separated from the developing sleeve surface by this repulsion magnetic field, and is collected in the developer collection chamber 28M.

The regulating magnetic pole Nb and the pump-up magnetic pole Sc that is adjacent to the regulating magnetic pole Nb on the upstream side in the developing sleeve surface movement direction have different polarities from each other, thereby forming a magnetic field (not shown) in which these magnetic poles are connected by magnetic force lines. The pump-up magnetic pole Sc generates a stronger magnetic force compared to the case where a repulsion magnetic field is formed between the pump-up magnetic pole Sc and the regulating magnetic pole Nb. For this reason, a sufficient amount of developer around the supplying screw 32M can be attracted and pumped up to the developing sleeve surface.

However, with the configuration shown in FIG. 8, in the entire surface region of the developing sleeve in the surface movement direction, the portion corresponding to maximum magnetic force of the pump-up magnetic pole Sc extends across a region from where the pumping-up starts to where the layer thickness regulation starts. Therefore, on the developing sleeve surface, the regulated/accumulated developer, which accumulates on the developer that is being conveyed along with the rotation of the developing sleeve surface, is attracted to the developing sleeve surface with maximum magnetic force of the pump-up magnetic pole Sc. For this reason, considerable stress is applied to the regulated/accumulated developer, which may cause a spent phenomena and/or toner abrasion.

Figure 6:
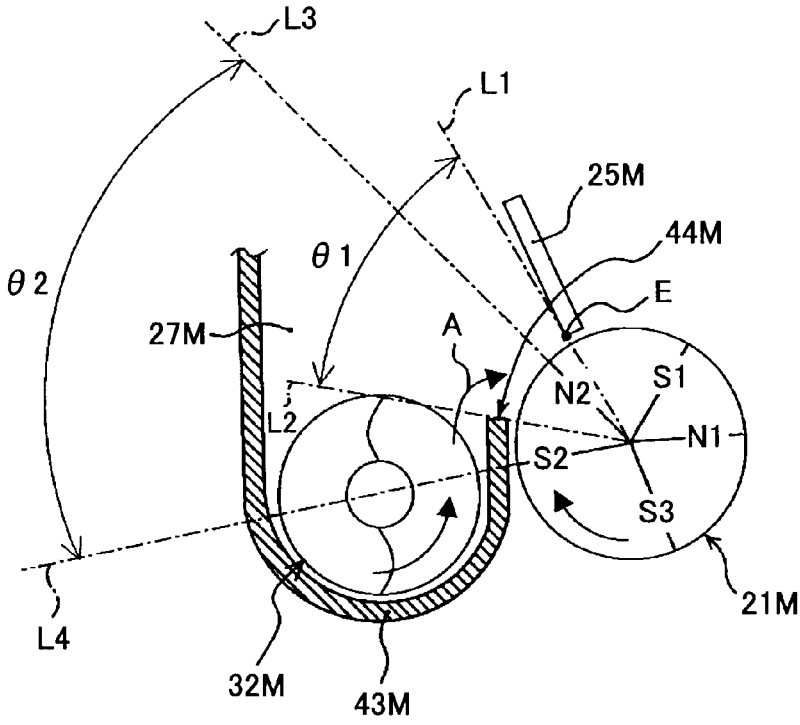
FIG. 6 is an enlarged view of a developing roller and a developer supplying chamber in the developing unit shown in FIG. 2.

Next, a characteristic configuration of the printer according to an embodiment of the present invention is described. FIG. 6 is an enlarged view of the developing roller 21M and the developer supplying chamber 27M in the developing unit for M in the printer according to an embodiment of the present invention. In FIG. 6, among the plural magnetic poles of the magnetic roller in the developing roller 21M, a magnetic pole denoted by N1 is a developing magnetic pole for attracting the developer on the developing sleeve surface at the developing position, while facing a photoconductor (not shown) via the developing sleeve. A magnetic pole denoted by N2 is a regulating magnetic pole for attracting the developer toward the developing sleeve surface at the layer thickness regulating position at which the developing doctor 25M regulates the layer thickness of the developer, while facing the tip of the developing doctor 25M via the developing sleeve. A magnetic pole denoted by S1 is a conveyance-after-regulation magnetic pole for holding the developer on the developing sleeve surface, which developer is being moved by the movement of the surface of the developing sleeve. Specifically, the magnetic pole S1 holds the developer that has passed through the layer thickness regulating position at which the developing doctor 25M has regulated the layer thickness, and that has not yet reached the developing position. A magnetic pole denoted by S2 is a pump-up magnetic pole functioning as a regulation upstream magnetic pole adjacent to the regulating magnetic pole N2 on the upstream side in the developing sleeve surface movement direction and pumping up the developer around the supplying screw 32M to the developing sleeve surface. A magnetic pole denoted by S3 is an after-developing-magnetic pole for holding the developer on the developing sleeve surface, which developer is being moved by the movement of the surface of the developing sleeve. Specifically, the magnetic pole S3 holds the developer that has passed through the developing position, and that has not yet reached the position facing a receiving conveying screw (not shown).

The after-developing-magnetic pole S3 and the pump-up magnetic pole S2 that is adjacent to the after-developing-magnetic pole S3 on the downstream side in the developing sleeve rotational direction have the same S polarity, thereby forming a repulsion magnetic field between these magnetic poles. Along with the movement of the developing sleeve surface, the developer that has reached the position facing a receiving screw (not shown) is separated from the developing sleeve surface by this repulsion magnetic field, and is collected in a developer collection chamber (not shown).

The developer supplying chamber 27M accommodating the supplying screw 32M is partitioned from the developer collection chamber that is not shown in FIG. 6 (denoted by 28M in FIG. 2) by a receiving member 43M which is part of the casing of the developing unit 20M. This receiving member 43M is made of a non-magnetic material such as resin. The receiving member 43M has a function of receiving the developer on its surface at the bottom of the supplying screw 32M in the gravity direction, in such a manner that the developer can be conveyed by the supplying screw 32M.

The supplying position where the developer is supplied from the supplying screw 32M to the developing sleeve is located at the following position. That is, the supplying position is where a downstream edge 44M of the receiving member 43M, which is the downstream edge in the surface movement direction of the supplying screw 32M, is facing a position downstream of a position where the pumping-up magnetic force is maximum (maximum pump-up magnetic force position denoted by S2), among the entire region of the surface of the developing sleeve.

When the developing sleeve of the developing roller 21M approaches the downstream edge 44M of the receiving member 43M as indicated by an arrow A in FIG. 6, the operation of pumping up the developer starts. Among the entire region of the surface of the developing sleeve, the position where the pumping-up magnetic force is maximum is upstream of the position where the pumping-up operation starts. Therefore, the maximum magnetic force generated by the pump-up magnetic pole S2 is not applied to the regulated/accumulated developer, which is accumulated in the region on the developing sleeve surface extending from the position where the pumping-up operation starts to the position facing the regulating member. Accordingly, compared to the case where the maximum magnetic force is applied, the stress on the regulated/accumulated developer is reduced, thereby mitigating a spent phenomenon and toner abrasion.

Furthermore, in this printer, the regulating magnetic pole N2 and the pump-up magnetic pole S2 that are adjacent to each other have different polarities, thereby forming a magnetic field in which these magnetic poles are connected by magnetic force lines. Accordingly, even if the developer has relatively low volume density, a sufficient magnetic force can be applied to the developer so that the volume of the developer increases at the regulating position. Furthermore, the developer that has been pumped up to the developing sleeve surface by the magnetic force of the pump-up magnetic pole S2 is kept on the developing surface throughout the course of being sent to the region facing the regulating magnetic pole N2 along with the movement of the developing sleeve surface. Therefore, the supplying screw 32M can face anywhere in the region extending between the regulating magnetic pole N2 and the pump-up magnetic pole S2. Accordingly, it is possible to mitigate changes in the developing density caused by environmental changes while improving the freedom in layout compared to the configuration shown in FIG. 7.

In FIG. 6, L1 denotes a virtual line connecting an edge E, which is the edge on the upstream side of the tip of the developing doctor 25M in the developing sleeve surface movement direction, and the rotational center of the developing sleeve. L2 denotes a virtual line connecting the downstream edge of the supplying position in the sleeve surface movement direction and the rotational center of the developing sleeve. θ1 denotes the angle between the virtual line L1 and the virtual line L2. L3 denotes a virtual line connecting a maximum regulating magnetic force position where the magnetic force from the regulating magnetic pole N2 is maximum among the entire region of the surface of the developing sleeve in the developing sleeve surface movement direction, and the rotational center of the developing sleeve. L4 denotes a virtual line connecting the maximum pump-up magnetic force position and the rotational center of the developing sleeve. θ2 denotes the angle between the virtual line L3 and the virtual line L4.

The regulated/accumulated developer that has been hampered, by the developing doctor 25M, from being rotated along with the developing sleeve, accumulates in the region indicated by the angle θ1 on the surface of the developing sleeve. In this printer, the angle θ1 is smaller than the angle 92. In this configuration, the region indicated by the angle θ1 where the regulated/accumulated developer accumulates includes only one of the plural maximum magnetic force positions corresponding to the magnetic poles on the developing sleeve surface. That is, only the maximum regulating magnetic force from the regulating magnetic pole N2 is positioned in this region indicated by the angle θ1. Accordingly, the stress on the regulated/accumulated developer is reduced compared to the case where plural maximum magnetic force positions from plural magnetic poles are positioned in this region indicated by the angle θ1.

The vertical direction (top to bottom) of the sheet plane of FIG. 6 extends in a vertical direction of the developing unit. The horizontal (left to right) direction of the sheet plane of FIG. 6 extends in a horizontal direction of the developing unit 20M. The downstream edge 44M of the receiving member 43M is positioned below the regulating magnetic pole N2 in the gravity direction. This means that the supplying position is positioned below the regulating magnetic pole N2 in the gravity direction. This configuration has a layout in which the top edge of the supplying screw 32M is positioned below the top edge of the developing sleeve, so that the developer is pumped up in a direction counter to the gravity direction from the supplying screw 32M to the developing sleeve as indicated by an arrow A in FIG. 6.

The region facing the developing doctor 25M on the developing sleeve in the surface movement direction, i.e., the developer regulating position, is on the downstream side of the maximum regulating magnetic pole position of the regulating magnetic pole N2. This position is within the reach of the magnetic force of the regulating magnetic pole N2, and thus has an N polarity, as a matter of course. In this configuration, the regulated/accumulated developer is attracted to the developing sleeve surface by the maximum magnetic force of the regulating magnetic pole N2, and therefore an appropriate amount of the regulated/accumulated developer can be retained on the developing sleeve surface. Furthermore, at the regulating position, the maximum magnetic force of the regulating magnetic pole N2 does not function. Therefore, it is possible to avoid applying excessive stress on the regulated/accumulated developer caused by this maximum magnetic force.

However, if the magnetic force of the regulating magnetic pole N2 were too strong, the stress on the regulated/accumulated developer would not be sufficiently reduced. Conversely, if the magnetic force of the regulating magnetic pole N2 were too weak, the following problem would arise. That is, in the case where the volume density of the developer considerably decreases due to environmental changes, the developer will be regulated without having its volume density sufficiently increased by attracting the magnetic carriers with the magnetic force. According to experiments conducted by inventors of the present invention, with the use of the regulating magnetic pole N2 having a magnetic flux density of more than or equal to 0.03 T and less than or equal to 0.08 T, it was possible to sufficiently mitigate a spent phenomenon and toner abrasion in the regulated/accumulated developer, while sufficiently mitigating fluctuations in the amount of toner conveyed to the developing position caused by fluctuations in the volume density of the developer. Therefore, in the printer according to an embodiment of the present invention, the regulating magnetic pole N2 has a magnetic flux density of more than or equal to 0.03 T and less than or equal to 0.08 T.

The developing doctor 25M is disposed in such a manner that its surface extending in a direction closest to the normal line direction of the developing sleeve is tilted by more than or equal to 20° with respect to the vertical direction. With such a configuration, part of the regulated/accumulated developer regulated by the developing doctor 25M, which could not be held on the developing sleeve surface by the magnetic force of the regulating magnetic pole N2, can smoothly drop into the developer supplying chamber 27M by gravity. Accordingly, it is possible to prevent an increase in the stress on the regulated/accumulated developer, which stress is increased when an excessive amount of regulated/accumulated developer accumulates.

The above is a detailed description of the developing unit 20M for M; the developing units for the other colors have the same configuration as that of the developing unit 20M for M.

The above is a description of a printer employing a so-called tandem method, in which toner images of respective colors formed by plural toner image forming units are superposed on each other and transferred to obtain a full color image. The present invention is also applicable to an image forming apparatus that forms full color images by a single method. The single method is performed as follows. Plural developing units for respective colors are provided around a latent image carrier such as a photoconductor. The developing units are sequentially used one after the other so that visible images of respective colors formed on the latent image carrier are sequentially transferred to an intermediate transfer body in such a manner as to be superposed on one another. The present invention is also applicable to an image forming apparatus that only forms monochrome images.

The printer according to an embodiment of the present invention is provided with the receiving screw 35M. The receiving screw 35M receives the developer from a particular position on the surface of the developing sleeve acting as a developer carrying member. Specifically, the developer is received from a position where the developer has passed though the developing position and has not yet reached the supplying position. The receiving screw 35M conveys the received developer in its rotational axial direction. Then, the developer is passed from the receiving screw 35M to the supplying screw 32M via the tilt screw 38M which is another screw. That is, the developer is supplied to and collected from the supplying screw 32M by different screws. In this configuration, the consumed developer is prevented from returning from the developing sleeve directly to the supplying screw 32M, thereby stabilizing the toner density of the developer in the developer conveyance direction, which developer is being conveyed by the supplying screw 32M. Accordingly, the developing density can be more stable compared to the case of using a single supplying screw for supplying and collecting the developer.

The printer according to an embodiment of the present invention includes, as a developer carrying member, a tubular developing sleeve whose surface can be rotated. As a magnetic field generating member, a roller type magnet roller is provided inside the tubular developing sleeve. With such a configuration, the surface of the developing sleeve can be moved while forming magnetic fields across substantially the entire surface of the developing sleeve, by a simple operation of rotating the developing sleeve.

Furthermore, in the printer according to an embodiment of the present invention, the angle θ1 is between the virtual line L1 and the virtual line L2. The virtual line L1 connects the edge E, which is the edge on the upstream side of the tip of the developing doctor 25M acting as the regulating member in the developing sleeve surface movement direction, and the rotational center of the developing sleeve. The virtual line L2 connects the downstream edge of the supplying position in the sleeve surface movement direction and the rotational center of the developing sleeve. The angle θ1 is between the virtual line L1 and the virtual line L2. The virtual line L3 connects a maximum regulating magnetic force position of the regulating magnetic pole N2 among the entire region of the surface of the developing sleeve in the developing sleeve surface movement direction, and the rotational center of the developing sleeve. The virtual line L4 connects the maximum pump-up magnetic force position of the pump-up magnetic pole S2 and the rotational center of the developing sleeve. The angle θ2 is between the virtual line L3 and the virtual line L4. The angle θ1 is smaller than the angle θ2. In such a configuration, as described above, it is possible to avoid applying excessive stress on the regulated/accumulated developer caused by the maximum magnetic force of the regulating magnetic pole N2 at the regulating position, while holding an appropriate amount of the regulated/accumulated developer on the developing sleeve surface.

In the printer according to an embodiment of the present invention, the supplying position is positioned below the regulating magnetic pole N2 in the gravity direction. In this configuration, only one of the plural maximum magnetic force positions corresponding to the plural magnetic poles, i.e., only the maximum regulating magnetic force from the regulating magnetic pole N2 is facing the region where the regulated/accumulated developer is accumulating. Accordingly, compared to the case where plural maximum magnetic force positions from plural magnetic poles are facing this region, the stress on the regulated/accumulated developer is reduced.

In the printer according to an embodiment of the present invention, the region facing the developing doctor 25M on the developing sleeve is on a downstream side of the maximum regulating magnetic force position (the maximum magnetic flux density position) of the regulating magnetic pole N2, in the surface movement direction. As described above, this configuration has a layout in which the top edge of the supplying screw 32M is positioned below the top edge of the developing sleeve, so that the developer is pumped up in a direction counter to the gravity direction from the supplying screw 32M to the developing sleeve.

In the printer according to an embodiment of the present invention, the regulating magnetic pole N2 has a magnetic flux density of more than or equal to 0.03 T and less than or equal to 0.08 T. Therefore, as described above, with such a configuration, it is possible to sufficiently mitigate a spent phenomenon and toner abrasion in the regulated/accumulated developer, while sufficiently mitigating fluctuations in the amount of toner conveyed to the developing position caused by fluctuations in the volume density of the developer.

In the printer according to an embodiment of the present invention, the developing doctor 25M, which is a plate-type regulating member, is disposed in such a manner as to be tilted by more than or equal to 20° with respect to the vertical direction. Therefore, as described above, it is possible to prevent an increase in the stress on the regulated/accumulated developer, which stress is increased when an excessive amount of regulated/accumulated developer accumulates.

According to one embodiment of the present invention, a developing device includes a developer carrying body including a developer carrying member configured to carry, on its moving surface, a developer including toner and magnetic carriers, and a magnetic field generating member including plural magnetic poles immovably provided inside the developer carrying member and arranged along a surface movement direction of the developer carrying member, wherein the developer carrying body is configured to convey the developer, along with the movement of the moving surface of the developer carrying member, to a developing position facing a latent image carrier of an image forming apparatus to develop a latent image on the latent image carrier; a supplying screw configured to supply the developer to the developer carrying member by conveying the developer in a rotational axial direction of the supplying screw; a receiving member configured to receive the developer on a surface of the receiving member, below the supplying screw in a gravity direction, in such a manner that the developer on the surface can be conveyed by the supplying screw; and a regulating member configured to regulate a layer thickness of the developer being carried on a surface region of the developer carrying member after the developer has passed a supplying position where the developer is supplied from the supplying screw to the developer carrying member, and before the developer reaches the developing position, while the regulating member is facing said surface region with a predetermined gap therebetween, wherein the magnetic field generating member further includes a regulating magnetic pole facing the regulating member via the developer carrying member, and a pump-up magnetic pole disposed adjacent to the regulating magnetic pole on an upstream side of the regulating magnetic pole in the surface movement direction of the developer carrying member, wherein the pump-up magnetic pole is configured to pump up the developer being conveyed by the supplying screw to the moving surface of the developer carrying member by attracting this developer with a pump-up magnetic force of the pump-up magnetic pole; and in the magnetic field generating member, the regulating magnetic pole and the pump-up magnetic pole have different polarities from each other, and among an entire region of the moving surface of the developer carrying member in the surface movement direction, a maximum pump-up magnetic force position where the pump-up magnetic force is maximum faces an upstream position with respect to the supplying position.

Additionally, the developing device further includes a receiving screw configured to receive the developer from a surface portion of the developer carrying member at which the developer has passed the developing position and that has not yet reached the supplying position, to convey this developer in the rotational axial direction of the receiving screw, and to pass this developer to the supplying screw directly from the receiving screw or via another screw.

Additionally, in the developing device, the developer carrying member includes a tubular-type member whose surface is movable by rotating; and the magnetic field generating member includes a roller-type magnetic roller provided inside said tubular-type member.

Additionally, in the developing device, a first virtual line connects an edge on a tip of the regulating member, which edge is an upstream edge of said tip in the surface movement direction, and a rotational center of the developer carrying member; a second virtual line connects a downstream edge of the supplying position in the surface movement direction, and said rotational center; an angle θ1 is formed between the first virtual line and the second virtual line; a third virtual line connects a maximum regulating magnetic force position, where a regulating magnetic force of the regulating magnetic pole is maximum among the entire region of the moving surface of the developer carrying member in the surface movement direction, and said rotational center; a fourth virtual line connects the maximum pump-up magnetic force position and said rotational center; an angle θ2 is formed between the third virtual line and the fourth virtual line; and the angle θ1 is smaller than the angle θ2.

Additionally, in the developing device, the supplying position is positioned below the regulating magnetic pole in the gravity direction.

Additionally, in the developing device, the developer carrying member faces the regulating member at a position on a downstream side in the surface movement direction with respect to the a maximum regulating magnetic force position where a regulating magnetic force of the regulating magnetic pole is maximum among the entire region of the moving surface of the developer carrying member in the surface movement direction.

Additionally, in the developing device, the regulating magnetic pole has a magnetic flux density of more than or equal to 0.03 T and less than or equal to 0.08 T.

Additionally, in the developing device, the regulating member includes a plate-type member that is disposed in such a manner as to be tilted by more than or equal to 20° with respect to a vertical direction.

According to one embodiment of the present invention, an image forming apparatus includes a latent image carrier configured to carry a latent image; and a developing unit configured to develop the latent image on the latent image carrier, wherein the developing unit includes the above-described developing device.

According to the embodiments of the present invention, the agent carrying member starts pumping up the developer around the supplying screw upon reaching the supplying position where the developer is supplied from the supplying screw. The maximum pump-up magnetic force position in the surface movement direction of the agent carrying member faces an upstream position with respect to the position where the pump-up starts. Therefore, the maximum pump-up magnetic force is not exerted on the regulated/accumulated developer accumulating on the surface of the agent carrying member in a region extending from the position where the pump-up starts to the position facing the regulating member. Accordingly, compared to a case where this maximum magnetic force is exerted, the stress on the regulated/accumulated developer can be reduced, and a spent phenomenon and toner abrasion can be mitigated.

Furthermore, according to the embodiments of the present invention, the regulating magnetic pole and the pump-up magnetic pole are adjacent to each other, and have different polarities, thus forming a magnetic field connecting both poles with magnetic force lines. Accordingly, even if the developer has relatively low volume density, a sufficient magnetic force can be applied to the developer so that the volume of the developer increases at the position facing the regulating member. Furthermore, the developer that has been pumped up to the surface of the agent carrying member by the magnetic force of the pump-up magnetic pole is kept on the surface of the agent carrying member throughout the course of being sent to the region facing the regulating magnetic pole along with the surface movement of the agent carrying member. Therefore, the supplying screw can face anywhere in the region extending between the regulating magnetic pole and the pump-up magnetic pole corresponding to a regulation upstream magnetic pole. Accordingly, it is possible to mitigate changes in the developing density caused by environmental changes while improving the freedom in layout compared to the conventional technology.

The present invention is not limited to the specifically disclosed embodiment, and variations and modifications may be made without departing from the scope of the present invention.

The present application is based on Japanese Priority Patent Application No. 2007-097073, filed on Apr. 3, 2007, the entire contents of which are hereby incorporated by reference.

What is claimed is:

1. A developing device comprising:

a developer carrying body comprising an agent carrying member configured to carry, on its moving surface, a developer comprising toner and magnetic carriers, and a magnetic field generating member comprising plural magnetic poles immovably provided inside the agent carrying member and arranged along a surface movement direction of the agent carrying member, wherein the developer carrying body is configured to convey the developer, along with the movement of the moving surface of the agent carrying member, to a developing position facing a latent image carrier of an image forming apparatus to develop a latent image on the latent image carrier;

a supplying member configured to supply the developer to the agent carrying member by conveying the developer in a rotational axial direction of the supplying member; and a regulating member configured to regulate a layer thickness of the developer being carried on a surface region of the agent carrying member after the developer has passed a supplying position where the developer is supplied from the supplying member to the agent carrying member, and before the developer reaches the developing position, while the regulating member is facing said surface region with a predetermined gap therebetween, wherein:

the magnetic field generating member further comprises a regulating magnetic pole facing the regulating member via the agent carrying member, and a pump-up magnetic pole disposed adjacent to the regulating magnetic pole on an upstream side of the regulating magnetic pole in the surface movement direction of the agent carrying member, wherein the pump-up magnetic pole is configured to pump up the developer being conveyed by the supplying member to the moving surface of the agent carrying member by attracting this developer with a pump-up magnetic force of the pump-up magnetic pole; and in the magnetic field generating member, the regulating magnetic pole and the pump-up magnetic pole have different polarities from each other, and a maximum pump-up magnetic force position, where the pump-up magnetic force on the moving surface of the agent carrying member is maximum, faces an upstream position with respect to the supplying position.

2. The developing device according to claim 1, further comprising:

a receiving screw configured to receive the developer from a surface portion of the agent carrying member at which the developer has passed the developing position and that has not yet reached the supplying position, to convey this developer in the rotational axial direction of the receiving screw, and to pass this developer to the supplying screw directly from the receiving screw or via another screw.

3. The developing device according to claim 1, wherein:

the agent carrying member comprises a tubular-type member whose surface is movable by rotating; and the magnetic field generating member comprises a roller-type magnetic roller provided inside said tubular-type member.

4. The developing device according to claim 3, wherein:

a first virtual line connects an edge on a tip of the regulating member, which edge is an upstream edge of said tip in the surface movement direction, and a rotational center of the agent carrying member;

a second virtual line connects a downstream edge of the supplying position in the surface movement direction, and said rotational center;

an angle $\theta 1$ is formed between the first virtual line and the second virtual line;

a third virtual line connects a maximum regulating magnetic force position, where a regulating magnetic force of the regulating magnetic pole is maximum among the entire region of the moving surface of the agent carrying member in the surface movement direction, and said rotational center;

a fourth virtual line connects the maximum pump-up magnetic force position and said rotational center;

an angle $\theta 2$ is formed between the third virtual line and the fourth virtual line; and the angle $\theta 1$ is smaller than the angle $\theta 2$.

5. The developing device according to claim 1, wherein:

the supplying position is positioned below the regulating magnetic pole in the gravity direction.

6. The developing device according to claim 5, wherein:

the regulating member comprises a plate-type member that is disposed in such a manner as to be tilted by more than or equal to 20° with respect to a vertical direction.

7. The developing device according to claim 1, wherein:

the agent carrying member faces the regulating member at a position on a downstream side in the surface movement direction with respect to the a maximum regulating magnetic force position where a regulating magnetic force of the regulating magnetic pole is maximum among the entire region of the moving surface of the agent carrying member in the surface movement direction.

8. The developing device according to claim 1, wherein:

the regulating magnetic pole has a magnetic flux density of more than or equal to 0.03 T and less than or equal to 0.08 T.

9. An image forming apparatus comprising:

a latent image carrier configured to carry a latent image; and a developing unit configured to develop the latent image on the latent image carrier, wherein:

the developing unit comprises the developing device according to claim 1.

10. The developing device according to claim 1, wherein the supplying member is a screw.

11. The developing device according to claim 1, further comprising:

a receiving member configured to receive the developer on a surface of the receiving member, below the supplying member in a gravity direction, such that the developer on the surface is conveyed by the supplying member.

* * * * *